US007300169B1

(12) United States Patent
Yue

(10) Patent No.: US 7,300,169 B1
(45) Date of Patent: Nov. 27, 2007

(54) VIEWING STATION WITH RETRACTABLE MIRROR

(76) Inventor: Chi Yau Yue, Block 4, Unit 10, 5/F, Profit Industrial Building, 1-15 Kwai Fung, Crescent, Hong Kong (HK)

( * ) Notice: Subject to any disclaimer, the term of this patent is extended or adjusted under 35 U.S.C. 154(b) by 0 days.

(21) Appl. No.: 11/715,119

(22) Filed: Mar. 8, 2007

(51) Int. Cl.
*G02B 5/08* (2006.01)
*G02B 7/182* (2006.01)
*F21V 33/00* (2006.01)

(52) U.S. Cl. ..... 359/854; 359/857; 359/862; 359/865; 359/881; 362/135; 362/142; 362/260

(58) Field of Classification Search ..... 359/850, 359/854, 855, 856, 857, 860, 865, 872, 881, 359/862; 362/135, 136, 140, 141, 142, 260
See application file for complete search history.

(56) References Cited

U.S. PATENT DOCUMENTS

| | | | | | |
|---|---|---|---|---|---|
| 71,320 | A * | 11/1867 | Neagles | 359/860 |
| 115,898 | A * | 6/1871 | Roberts | 359/860 |
| 896,658 | A * | 8/1908 | McGiehan | 359/854 |
| 1,859,592 | A * | 5/1932 | Marchand | 362/141 |
| 2,161,264 | A * | 6/1939 | Simjian | 359/860 |
| 2,192,158 | A * | 2/1940 | Simjian | 359/860 |
| 2,254,718 | A * | 9/1941 | Welch | 362/141 |
| 3,709,585 | A * | 1/1973 | Tsai | 359/860 |
| 4,119,107 | A * | 10/1978 | Pinzone et al. | 132/316 |
| 4,758,078 | A * | 7/1988 | Bracamonte | 359/841 |
| 4,994,946 | A * | 2/1991 | NakaMats | 362/282 |
| 5,056,905 | A * | 10/1991 | Jensen | 359/843 |
| 6,347,876 | B1 * | 2/2002 | Burton | 362/141 |

* cited by examiner

*Primary Examiner*—Ricky D. Shafer
(74) *Attorney, Agent, or Firm*—Eric Hanscom

(57) ABSTRACT

The embodiments of the invention provide a viewing system having an upright member, a first mirror coupled to the upright member, a light source coupled to the upright member, and a retractable mirror assembly coupled to the upright member. The retractable mirror assembly includes a horizontal support coupled on one end to the upright member, an adjustable vertical support coupled on one end to the other end of the horizontal support, and a second mirror coupled to the other end of the adjustable vertical support. A user can adjust the position of the second mirror by retracting or extending the adjustable vertical support. The system can include a remote control or a control switch coupled to the adjustable vertical support to control the extension and retraction of the adjustable vertical support. The second mirror can be foldable to allow for multiple viewing angles.

18 Claims, 6 Drawing Sheets

VIEWING STATION WITH RETRACTABLE MIRROR

BACKGROUND

1. Field of the Embodiments of the Invention

The embodiments of the invention relate to the field of viewing station apparatus. More specifically, the embodiments of the present invention relate to a viewing station having a retractable mirror.

2. Description of the Related Art

Hair styling and grooming is often performed in a salon or barber shop setting. During the cutting or styling, a person is traditionally faced in front of a single mirror, allowing the client to only see the work performed on the front of his or her hair. If a client desires to see how the back of his or her hair is being styled or cut, the hair stylist or barber must rotate the user's chair away from a first mirror and position a second mirror such that when a client looks through the second mirror they can see the reflection of the back of their head from the first mirror. While this procedure is effective, it is often inconvenient and requires the barber or hair stylist to stop performing the hair styling and/or cutting operations, which increases the time a client must spend at the hair salon or barbershop. Further, as a client cannot view the acts being performed on the back of their hair while they are occurring, current practice allows for the risk that the hair stylist may not be styling or cutting the client's hair exactly to the client's satisfaction, which can produce undesirable results. Therefore, a need exists for an apparatus that overcomes these disadvantages.

In this respect, before explaining at least one embodiment of the invention in detail it is to be understood that the embodiments of the invention are not limited in their application to the details of construction and to the arrangement of the components set forth in the following description or illustrated in the drawings. The embodiments of the invention are capable of being practiced and carried out in various ways. In addition, it is to be understood that the phraseology and terminology employed herein are for the purpose of description and should not be regarded as limiting.

BRIEF SUMMARY OF INVENTION

One embodiment of the invention provides a viewing system having an upright member, a first mirror coupled to the upright member, a light source coupled to the upright member, and a retractable mirror assembly coupled to the upright member. The retractable mirror assembly includes a horizontal support coupled on one end to the upright member, an adjustable vertical support coupled on one end to the other end of the horizontal support, and a second mirror coupled to the other end of the adjustable vertical support. A user can adjust the position of the second mirror by retracting or extending the adjustable vertical support. The retractable mirror assembly can be coupled to the upright member above the light source and the first mirror can be coupled to the upright member below the light source. The adjustable vertical support can be a telescoping member or other member that can extend or retract along an axis.

In other embodiments, the viewing system can include a control switch coupled thereto to control the extension and retraction of the adjustable vertical support. The control switch can be coupled to the upright member or to the adjustable vertical member. In another embodiment, the viewing system can include a receiver coupled thereto for receiving signals to control the extension and retraction of the adjustable vertical support.

In further embodiments, the viewing system can include a second mirror having a middle section and an end section on each side of the middle section, the middle section connected to each end section by a hinge, wherein each end section can be positioned at a different angle than the middle section. This can allow for a user to position the second mirror to allow a person to view his or her hair from various angles. In other embodiments, the upright member can contain a hollow interior region therein, whereby electrical wires can be positioned therethough to control the light source and/or the adjustable vertical support.

There has thus been outlined, rather broadly, features of some of the embodiments of the invention in order that the detailed description thereof may be better understood, and in order that the present contribution to the art may be better appreciated.

BRIEF DESCRIPTION OF THE DRAWINGS

The accompanying drawings, which are incorporated in and form a part of this specification, illustrate embodiments of the invention and together with the description, serve to explain the principals of some of the embodiments of the invention.

DETAILED DESCRIPTION OF THE INVENTION

Figure 1:
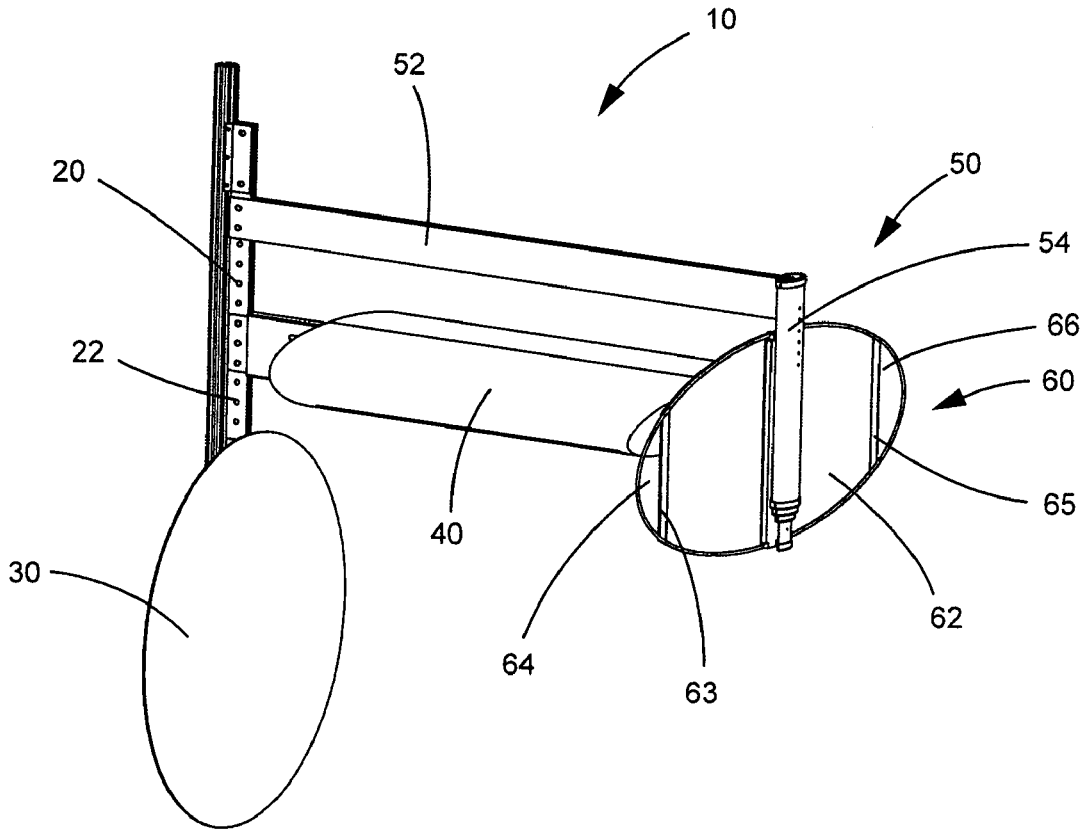
FIG. 1 shows a front perspective view of an embodiment of the viewing station with retractable mirror.

Referring now to the drawings, wherein similar parts are identified by like reference numerals, FIG. 1 shows a front perspective view of an embodiment of the viewing station with retractable mirror 10. Device 10 includes an upright member 20, a first mirror 30, a light source 40, a retractable mirror assembly 50, and a second mirror 60. Device 10 is preferably utilized in a beauty salon, barber shop, day spa, cosmetic application facility, or other environment requiring both accurate lighting and multiple viewing means. However, other uses of device 10 are covered within the scope of this invention.

Upright member 20 can comprise various shapes and sizes depending on the application and design of device 10, as well as be fabricated from various materials such as metal and polymer-based materials. First mirror 30, light source 40, and retractable mirror assembly 50 are coupled to upright member 20. Upright member 20 can contain a plurality of holes 22 located therein to allow first mirror 30, light source 40, and retractable mirror assembly 50 to be coupled thereto.

Preferably, first mirror 30 is coupled to upright member 20 below light source 40 and retractable mirror assembly 50, and light source 40 is coupled to upright member 20 below retractable mirror assembly 50. However, other spatial arrangements of first mirror 30, light source 40, and retractable mirror assembly 50 in relation to upright member 20 are within the scope of the embodiments of the invention. First mirror 30 can vary in both shape and size to suit particular applications. First mirror 30 is preferably a fixed angle mirror. However, in other embodiments, first mirror 30 can comprise various hinged sections to allow first mirror 30 to be folded at various angles to allow for multiple angle viewing.

Light source 40 is preferably a light box that can contain multiple fluorescent tubes (not shown) having a high color rendering index in order to better reflect the true color of a the hair or makeup of the client. Light source 40 preferably contains six fluorescent tubes. However, light source 40 can contain other light elements, such as incandescent bulbs and light emitting diodes, as would be recognized by one with ordinary skill in the art. Light source 40 can comprise various shapes and sizes to suit the particular lighting requirements of various work environments. Further, light source 40 may be comprised of more than one light box, with each light box containing one or more lighting elements.

Retractable mirror assembly 50 comprises a horizontal support 52 and an adjustable vertical support 54. Horizontal support 52 is coupled on one end to upright member 20 and on the other end to adjustable vertical support 54. Horizontal support 52 can comprise various shapes and sizes depending on the application and design of device 10, as well as be fabricated from various materials such as metal and polymer-based materials. Adjustable vertical support 54 preferably comprises a telescoping member having a base and more than one section connected to the base that can be secured within and extend outwardly from the base. Adjustable vertical support 54 can include a plurality of holes and a spring-loaded detent disposed in one of the holes, wherein the detent can be pressed to allow adjustable vertical support 54 to be extended or retracted to a desired length. In another embodiment, adjustable vertical support 54 can be comprised of a locking telescoping member wherein support 54 can be extended or retracted into a desired position by a user applying a force in an downward or upward direction, with the telescoping member locking into place at various intervals of expansion or retraction. Adjustable vertical support 54 can comprise other manual extension and retraction means as would be recognized in the art.

Second mirror 60 is coupled to the distal end of adjustable vertical support 54. A user can adjust the position of second mirror 60 by retracting or extending adjustable vertical support 54. Second mirror 60 can vary in both shape and size to suit particular applications. Second mirror 60 preferably contains a middle section 62, a first end 64, and a second end 66. The size relation between middle section 62, first end 64, and second end 66 is not limited by the figure shown. First end 64 is connected to middle section 62 by first hinge 63. Second end 66 is connected to middle section 62 by second hinge 65. Hinges 63 and 65 allow first end 64 and second end 66 to be positioned such that a subject can have multiple viewing angles while looking into second mirror 60.

Figure 2A:
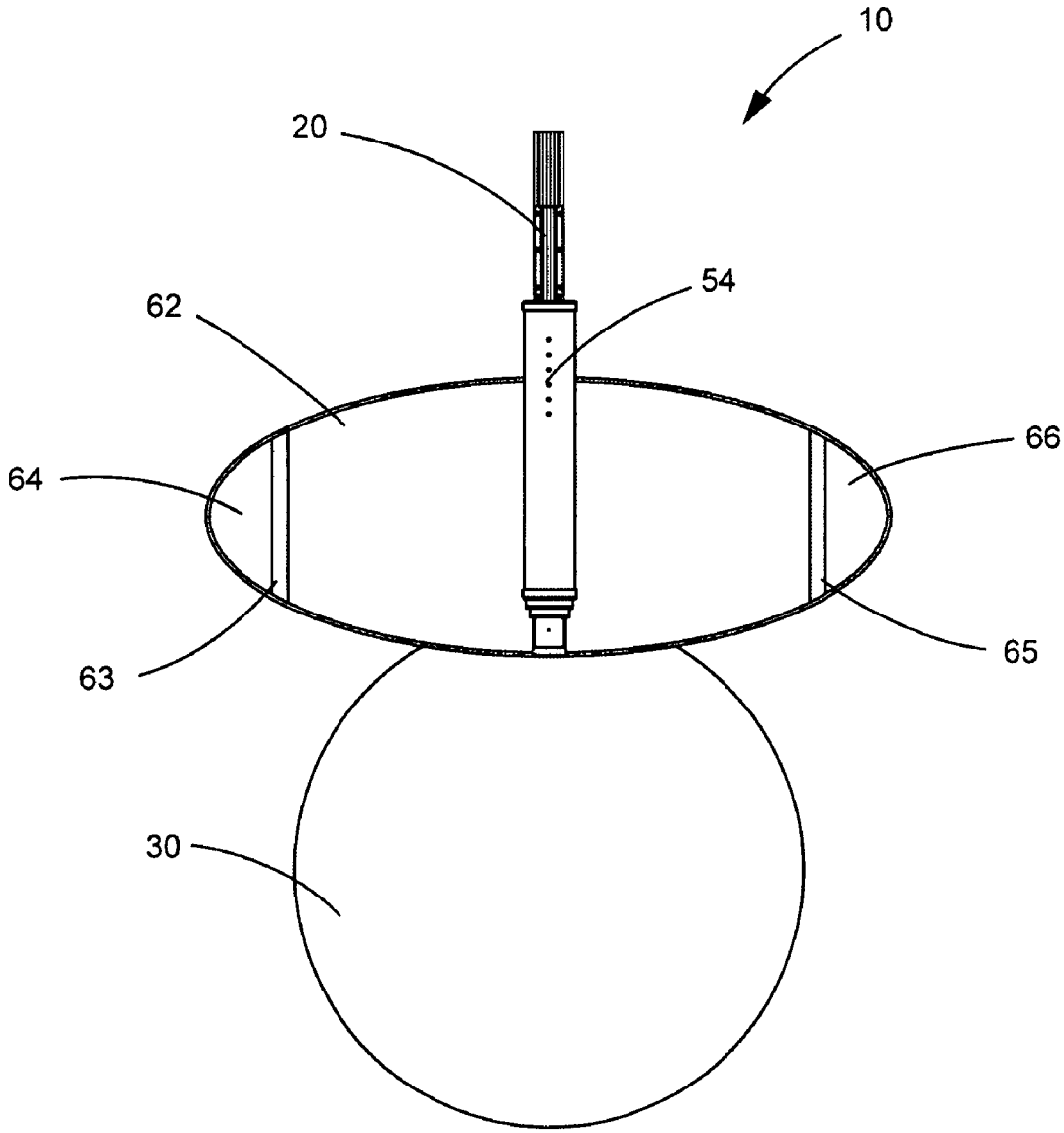
FIG. 2A shows a front view of an embodiment of the viewing station with retractable mirror, with the retractable mirror in the raised position.
Figure 2B:
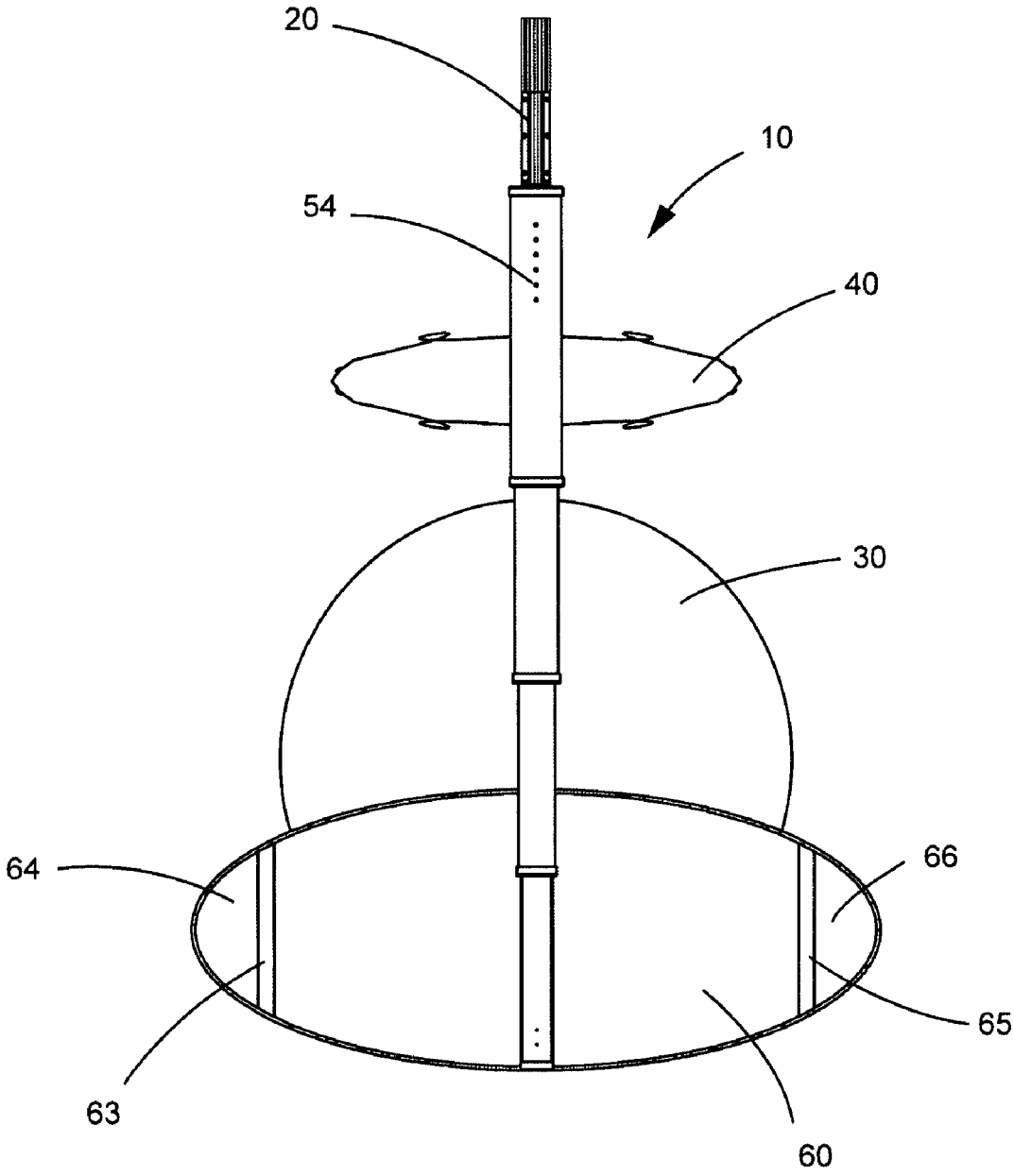
FIG. 2B shows a front view of an embodiment of the viewing station with retractable mirror, with the retractable mirror in the lowered position.

Referring now to FIGS. 2A and 2B, FIG. 2A shows a front view of an embodiment of the viewing station with retractable mirror 10, with second mirror 60 in the raised position. When second mirror 60 is in this position, adjustable vertical support 54 is in the fully retracted position. FIG. 2B shows a front view of an embodiment of the viewing station with retractable mirror 10, with second mirror 60 in the lowered position. When second mirror 60 is in the lowered position, adjustable vertical support 54 is in a position other than the fully retracted position. For example, when second mirror 60 is in the lowered position, adjustable vertical support 54 can be in a partially extended position or in a fully extended position. As discussed above, adjustable vertical support 54 can be raised or lowered by a user exerting either an upward or downward force upon adjustable vertical support 54.

Figure 3A:
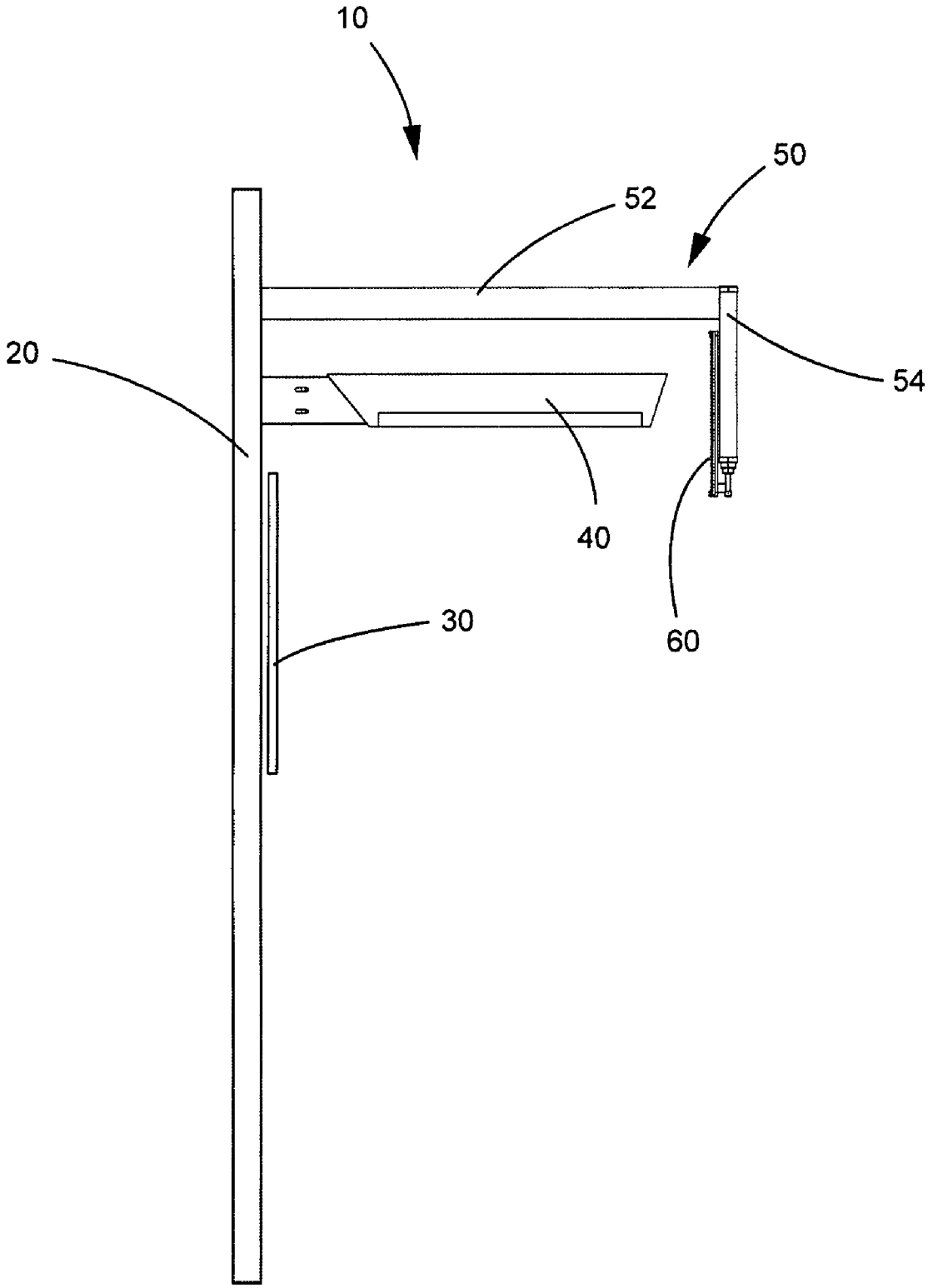
FIG. 3A shows a side view of an embodiment of the viewing station with retractable mirror, with the retractable mirror in the raised position.
Figure 3B:
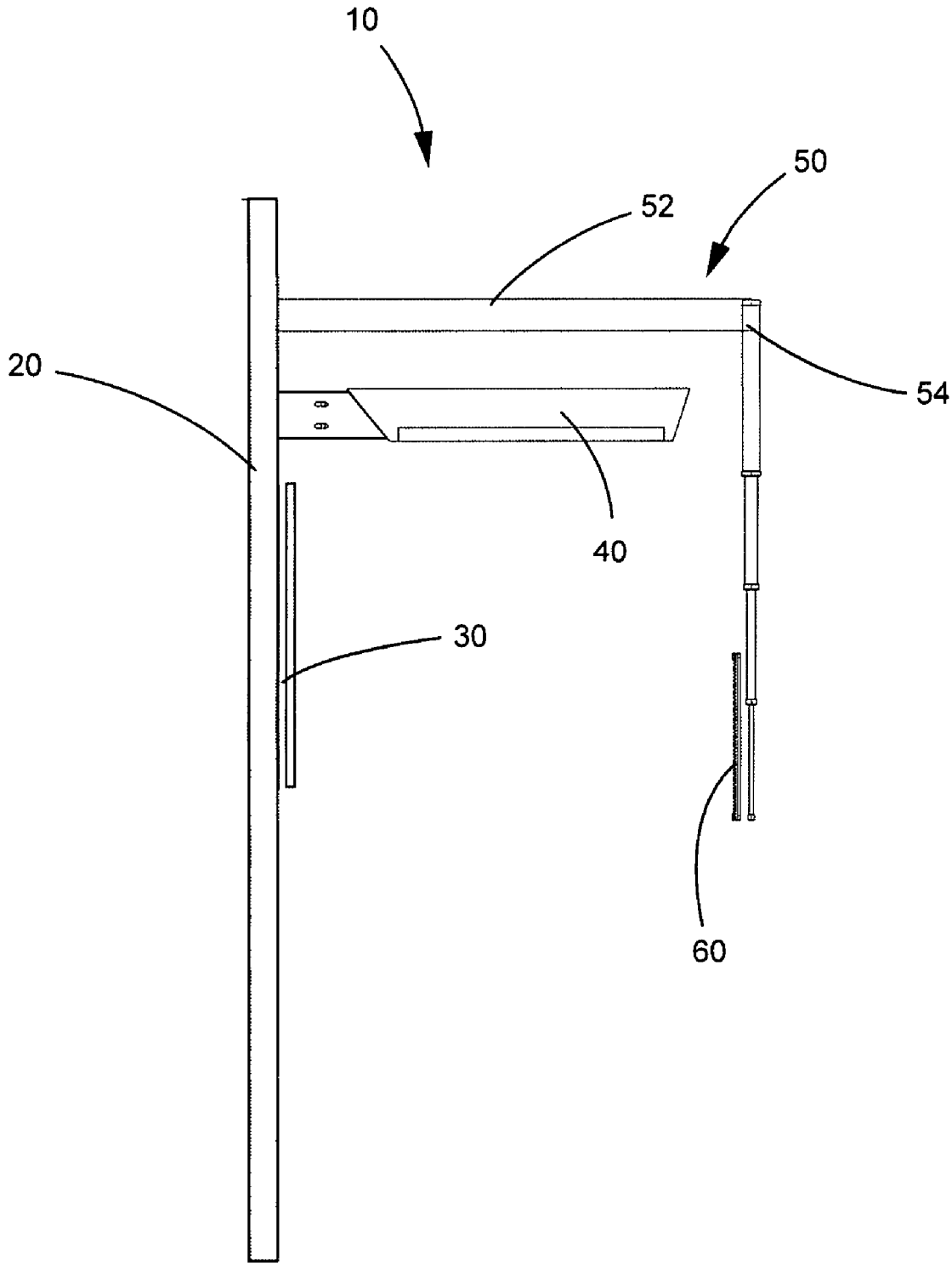
FIG. 3B shows a side view of an embodiment of the viewing station with retractable mirror, with the retractable mirror in the lowered position.

Referring now to FIGS. 3A and 3B, FIG. 3A shows a side view of an embodiment of the viewing station with retractable mirror 10. In this view, second mirror 60 is in the raised position. FIG. 3B shows a side view of an embodiment of the viewing station with retractable mirror 10, with second mirror 60 in the lowered position. FIGS. 3A and 3B illustrate a preferred orientation and spatial relationship between upright member 20, light source 40, retractable mirror assembly 50, and second mirror 60.

Figure 4:
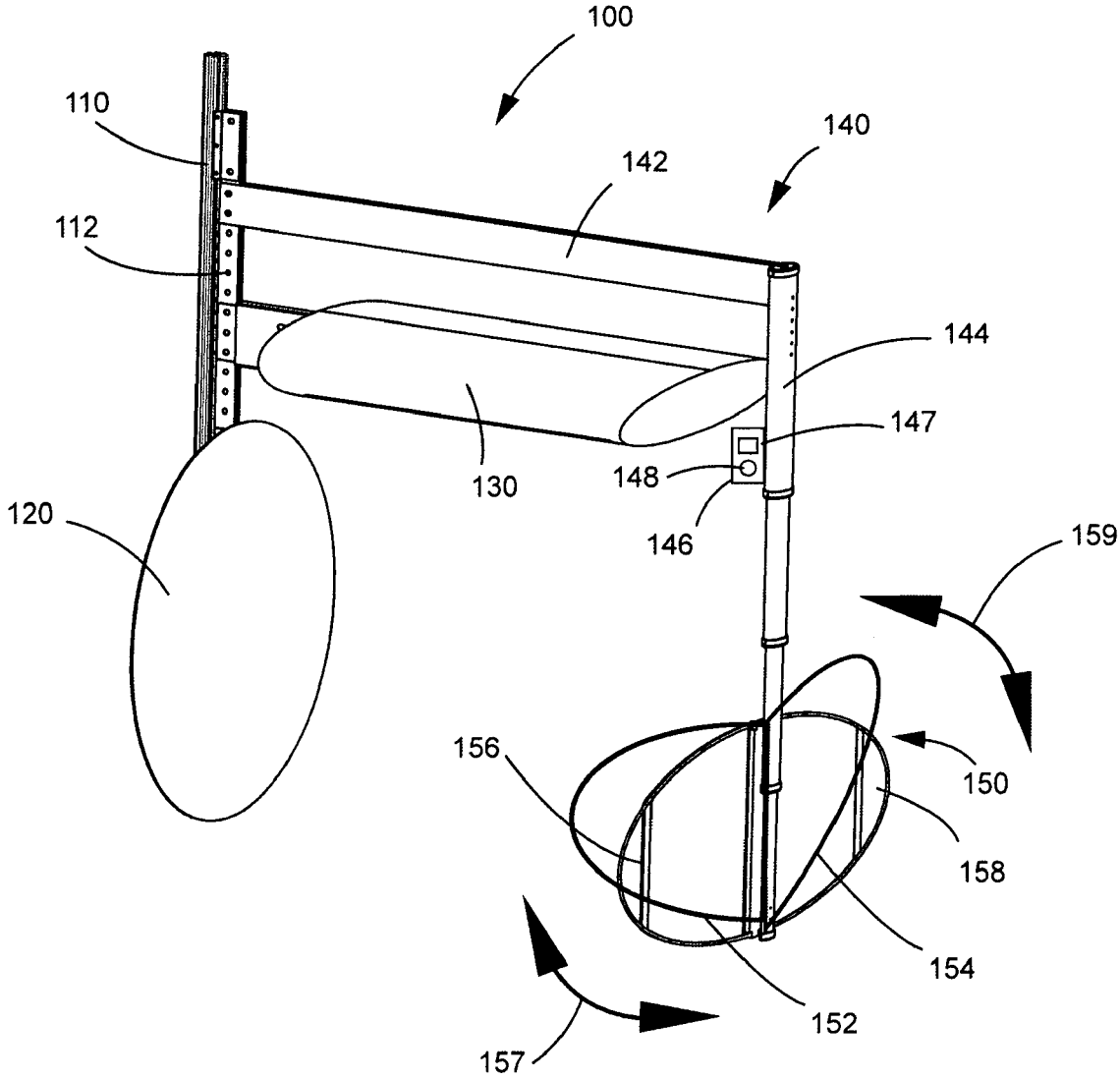
FIG. 4 shows a front perspective view of an embodiment of the viewing station with retractable mirror, including a foldable mirror.

FIG. 4 shows a front perspective view of an embodiment of the viewing station with retractable mirror 100. Device 100 includes an upright member 110, a first mirror 120, a light source 130, a retractable mirror assembly 140, and a second mirror 150. Device 100 is preferably utilized in a beauty salon, barber shop, day spa, cosmetic application facility, or other environment requiring both accurate lighting and viewing means. However, other uses of device 100 are covered within the scope of this invention.

Upright member 110 can comprise various shapes and sizes depending on the application and design of device 100, as well as be fabricated from various materials such as metal and polymer-based materials. First mirror 120, light source 130, and retractable mirror assembly 140 are coupled to upright member 110. Upright member 110 can contain a plurality of holes 112 located therein to allow first mirror 120, light source 130, and retractable mirror assembly 140 to be coupled thereto.

Preferably, first mirror 120 is coupled to upright member 110 below light source 130 and retractable mirror assembly 140, and light source 130 is coupled to upright member 110 below retractable mirror assembly 140. However, other spatial arrangements of first mirror 120, light source 130, and retractable mirror assembly 140 in relation to upright member 110 are within the scope of the embodiments of the invention. First mirror 120 can vary in both shape and size to suit particular applications. First mirror 120 is preferably a fixed angle mirror. However, in other embodiments, first mirror 120 can comprise various hinged sections to allow first mirror 120 to be folded at various angles to allow for multiple angle viewing.

Light source 130 is preferably a light box that can contain multiple fluorescent tubes (not shown) having a high color rendering index in order to better reflect the true color of a the hair or makeup of the client. Light source 130 preferably contains six fluorescent tubes. However, light source 130 can contain other light elements, such as incandescent bulbs and light emitting diodes, as would be recognized by one with ordinary skill in the art. Light source 130 can comprise various shapes and sizes to suit the particular lighting requirements of various work environments. Further, light source 130 may be comprised of more than one light box, with each light box containing one or more lighting elements.

Retractable mirror assembly 140 comprises a horizontal support 142, an adjustable vertical support 144, and a control box 146. Horizontal support 142 is coupled on one end to upright member 110 and on the other end to adjustable vertical support 144. Horizontal support 142 can comprise various shapes and sizes depending on the application and design of device 100, as well as be fabricated from various materials such as metal and polymer-based materials. Adjustable vertical support 144 preferably comprises a telescoping member having a base and more than one section connected to the base that can be secured within and extend outwardly from the base.

In this embodiment, adjustable vertical support 144 can be electronically raised or lowered using control box 146. Control box 146 can contain at least one button 148 that can raise or lower adjustable vertical support 144. Although control box 146 is shown coupled to adjustable vertical support 144, control box 146 can be located elsewhere on device 100 that may be convenient for a user. For example, control box 146 can be secured to upright member 110 or even coupled to light source 130. In device 100, upright member 110 can contain a hollow interior region therein, whereby electrical wires to operate adjustable vertical support 144 can be positioned therethough. Control box 146 can also contain a receiver 147 positioned therein, whereby receiver 147 can receive signals from a remote control (not shown) to control the retraction and extension of adjustable vertical support 144.

Second mirror 150 is coupled to the distal end of adjustable vertical support 144. A user can adjust the position of second mirror 150 by retracting or extending adjustable vertical support 144. Second mirror 150 can vary in both shape and size to suit particular applications. Second mirror 150 preferably contains a first middle section 152, a second middle section 154, a first end 156, and a second end 158. The size relation between first middle section 152, a second middle section 154, a first end 156, and a second end 158 is not limited by the figure as shown. First middle section 152 and second middle section 154 can be folded along the axis of connection of second mirror 150 to adjustable vertical support 144, as shown by arrows 157 and 159. This folding capability, along with the folding capabilities provided by the connection of first end 156 to first middle section 152 and second end 158 to second middle section 154, offer a wide variety of viewing angles to a user of second mirror 60.

With respect to the above description it is to be realized that the optimum dimensional relationships for the parts of the invention, including variations in size, materials, shape, form, function and manner of operation, assembly, and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described. Accordingly, all suitable modifications and equivalents fall within the scope of the present invention.

The above description is pointed out with particularity in the claims annexed to and forming a part of this disclosure. For a better understanding of the invention, its operating advantages and the specific advantages attained by its uses, reference should be made to the accompanying drawings and descriptive matter in which there are illustrated preferred embodiments of the invention.

Further, the purpose of the foregoing abstract is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting, as to the scope of the invention in any way.

What is claimed is:

1. A viewing system comprising:

a) an upright member;

b) a first mirror coupled to the upright member;

c) a light source coupled to the upright member; and d) a retractable mirror assembly coupled to the upright member, the retractable mirror assembly comprising:

i) a horizontal support coupled on one end to the upright member;

ii) an adjustable vertical support coupled on one end to the other end of the horizontal support; and iii) a second mirror coupled to the other end of the adjustable vertical support, whereby a user can adjust the position of the second mirror by retracting or extending the adjustable vertical support, and, wherein the second mirror is a foldable mirror, and, wherein the second mirror comprises a middle section and an end section on each side of the middle section, the middle section connected to each end section by a hinge, wherein each end section can be positioned at a different angle than the middle section.

2. The viewing system of claim 1, wherein the upright member contains a plurality of holes therein to allow the first mirror, the light source, and the retractable mirror assembly to be positioned at various locations with respect to the upright member.

3. The viewing system of claim 1 wherein the adjustable vertical support comprises a telescoping member.

4. The viewing system of claim 1 wherein the retractable mirror assembly is coupled to the upright member above the light source.

5. The viewing system of claim 1 wherein the first mirror is coupled to the upright member below the light source.

6. The viewing system of claim 1 wherein the light source comprises a fluorescent light source.

7. The viewing system of claim 1 wherein the upright member contains a hollow interior region therein, whereby electrical wires can be positioned therethough.

8. The viewing system of claim 1 further comprising a control box, where the control box is attached to the viewing system and where the control box comprises a control switch, whereby the control switch operates the retraction and extension of the adjustable vertical support.

9. The viewing system of claim 8, wherein the control box and the control switch are coupled to the adjustable vertical support.

10. The viewing system of claim 1 further comprising a control box, where the control box is attached to the viewing system and where the control box comprises a receiver, whereby the receiver can receive signals from a remote control to control the retraction and extension of the adjustable vertical support.

11. The viewing system of claim 10 wherein the adjustable vertical support comprises a telescoping member.

12. The viewing system of claim 10 further comprising a control switch coupled to the adjustable vertical support, whereby the control switch operates the retraction and extension of the adjustable vertical support.

13. The viewing system of claim 10 wherein the retractable mirror assembly is coupled to the upright member above the light source and the first mirror is coupled to the upright member below the light source.

14. The viewing system of claim 1, wherein the upright member is adjustable in height.

15. A viewing system comprising:

a) an upright member;

b) a first mirror coupled to the upright member;

c) a light source coupled to the upright member; and d) a retractable mirror assembly coupled to the upright member, the retractable mirror assembly comprising:

i) a horizontal support coupled on one end to the upright member;

ii) an adjustable vertical support coupled on one end to the other end of the horizontal support; and iii) a second mirror coupled to the other end of the adjustable vertical support, the second mirror having a middle section and an end section on each side of the middle section, the middle section connected to each end section by a hinge, wherein each end section can be positioned at a different angle than the middle section, whereby a user can adjust the position of the second mirror by retracting or extending the adjustable vertical support.

16. The viewing system of claim 15 further comprising a control box, where the control box is attached to the viewing system and where the control box comprises a receiver, whereby the receiver can receive signals from a remote control to control the retraction and extension of the adjustable vertical support.

17. The viewing system of claim 16, wherein the control box and the control switch are coupled to the adjustable vertical support.

18. A viewing system comprising:

a) an upright member;

b) a first mirror coupled to the upright member;

c) a light source coupled to the upright member; and d) a retractable mirror assembly coupled to the upright member, the retractable mirror assembly comprising:

i) a horizontal support coupled on one end to the upright member;

ii) an adjustable vertical support coupled on one end to the other end of the horizontal support; and iii) a second mirror coupled to the other end of the adjustable vertical support, the second mirror having a middle section and an end section on each side of the middle section, the middle section connected to each end section by a hinge, wherein each end section can be positioned at a different angle than the middle section, whereby a user can adjust the position of the second mirror by retracting or extending the adjustable vertical support, and, further comprising a control box, where the control box is attached to the viewing system and where the control box comprises a control switch coupled to the adjustable vertical support, whereby the control switch operates the retraction and extension of the adjustable vertical support.

* * * * *